US005222366A

United States Patent [19]

Herd et al.

[11] Patent Number: 5,222,366

[45] Date of Patent: Jun. 29, 1993

[54] THERMAL BUSBAR ASSEMBLY IN A CRYOSTAT DUAL PENETRATION FOR REFRIGERATED SUPERCONDUCTIVE MAGNETS

[75] Inventors: Kenneth G. Herd; Evangelos T. Laskaris, both of Schenectady, N.Y.

[73] Assignee: General Electric Company, Schenectady, N.Y.

[21] Appl. No.: 833,225

[22] Filed: Feb. 10, 1992

[51] Int. Cl.[5] ..... F25J 3/08

[52] U.S. Cl. ..... 62/51.1; 505/892

[58] Field of Search ..... 62/51.1; 505/892

[56] References Cited

U.S. PATENT DOCUMENTS

| | | | |
|---|---|---|---|
| 4,535,596 | 8/1985 | Laskaris | 62/51.1 |
| 4,635,450 | 1/1987 | Laskaris | 62/51.1 |
| 4,667,487 | 5/1987 | Miller et al. | 62/51.1 |
| 4,841,268 | 6/1989 | Burnett et al. | 62/51.1 |

*Primary Examiner*—Ronald C. Capossela

*Attorney, Agent, or Firm*—James R. McDaniel; Paul R. Webb, II

[57] ABSTRACT

This invention relates to thermal busbar assemblies in a cryostat dual penetration for refrigerated superconductive magnets. Such structures of this type, generally, allow heat to be conducted from the refrigerated superconductive magnet to the refrigeration cold head while isolating the magnet from the vibration created by the cold head.

13 Claims, 3 Drawing Sheets

THERMAL BUSBAR ASSEMBLY IN A CRYOSTAT DUAL PENETRATION FOR REFRIGERATED SUPERCONDUCTIVE MAGNETS

CROSS-REFERENCE TO RELATED APPLICATIONS

This application is related to commonly assigned U.S. patent applications Ser. Nos. 07/833,195 and 07/833,194 all to Herd et al. and entitled "Cold Head Mounting Assembly in a Cryostat Dual Penetration For Refrigerated Superconductive Magnets" and "High-Tc Superconducting Lead Assembly in a Cryostat Dual Penetration For Refrigerated Superconductive Magnets".

BACKGROUND OF THE INVENTION

1. Field of the Invention

This invention relates to thermal busbar assemblies in a cryostat dual penetration for refrigerated superconductive magnets. Such structures of this type, generally, allow heat to be conducted from the refrigerated superconductive magnet to the refrigeration cold head while isolating the magnet from the vibration created by the cold head and allowing differential thermal contraction between the magnets and the cold head.

2. Description of the Related Art

It is known in prior refrigerated superconductive magnets to use a cryorefrigeration system which employs a single cold head. The major limitation of these systems is the fact that if the single cold head malfunctions, the superconductive magnet may not be properly cooled, which could adversely affect the performance of the magnet. IN short, the system, typically was only as reliable as the cryorefrigerator itself. Therefore, a more advantageous system would be presented if this unreliability were reduced or eliminated.

In order to increase the reliability in refrigerated superconductive magnet systems, a redundant cold head system for a refrigerated magnet has been developed. Exemplary of such prior redundant systems is U.S. Pat. No. 5,111,665 to R. A. Ackermann, entitled "Redundant Cryorefrigerator System For a Refrigerated Superconductive Magnet", now allowed and assigned to the same assignee as the present invention. In U.S. Pat. No. 5,111,665 one cold head of the two used in the system cools the magnet. A redundant cold head does not contact the magnet and is held in a raised, standby position. If the main cold head malfunctions, the main cold head is raised so that it can be repaired, serviced or replaced and the redundant cold head is lowered to contact the magnet. In this manner, the cooling of the magnet should be substantially continuous. While This cryorefrigeration system has allowed the magnet to be run continuously, further reductions in the amount of vibration reaching the magnet would be achieved if the cold heads were not rigidly attached to the magnet. Vibration in the magnet is not desired because the vibration can cause artifacts in the image produced by the magnet. Consequently, further reductions in the vibration in the magnet while continuously cooling the magnet would be advantageous.

It is apparent from the above that there exists a need in the art for a thermal busbar assembly which conducts heat away from the magnet and towards the refrigerator cold head and which is capable of allowing the magnet to operate continuously, but which at the same time substantially prevents vibrations created by the cold head from reaching the magnets and allows differential thermal contraction between the cold head and the magnet. It is a purpose of this invention to fulfill this and other needs in the art in a manner more apparent to the skilled artisan once given the following disclosure.

SUMMARY OF THE INVENTION

Generally speaking, this invention fulfills these needs by providing a thermal busbar assembly for refrigerated superconductive magnets, comprising a vacuum enclosure means, a thermal shield means, a superconductive magnet, a first and second thermal station means, a lead busbar means electrically connected to said magnet means and thermally connected to said first heat station means, and a thermal busbar means thermally connected to said magnet means and said second thermal station means, and a second thermal busbar means thermally connected to said thermal shield means and said first heat station means.

In certain preferred embodiments, the thermal station means is a 10° K. heat station. Also, the thermal busbars allow differential motion between the magnet and the heat station in the radial, hoop and axial directions. Finally, the lead busbars are constructed of copper strips laminated with superconductive material and the thermal busbars are constructed of laminated copper sheets with each sheet being approximately 5 mils thick.

In another further preferred embodiment, heat is transferred by the thermal busbar assembly from the magnet to a refrigerator cold head while vibrations created by the cold head are isolated from the magnet by the thermal busbar assembly.

The preferred thermal busbar assembly, according to this invention, offers the following advantages: easy attachment to the magnet, excellent thermal conduction characteristics; good stability; good durability; and improved vibration isolation characteristics. In fact, in many of the preferred embodiments, these factors of thermal conduction and vibration isolation are optimized to an extent considerably higher than heretofore achieved in prior, known thermal busbar assemblies.

BRIEF DESCRIPTION OF THE DRAWINGS

The above and other features of the present invention which will become more apparent as the description proceeds are best understood by considering the following detailed description in conjunction with the accompanying drawings wherein like characters represent like parts throughout the several views and in which.

DETAILED DESCRIPTION OF THE INVENTION

Figure 1:
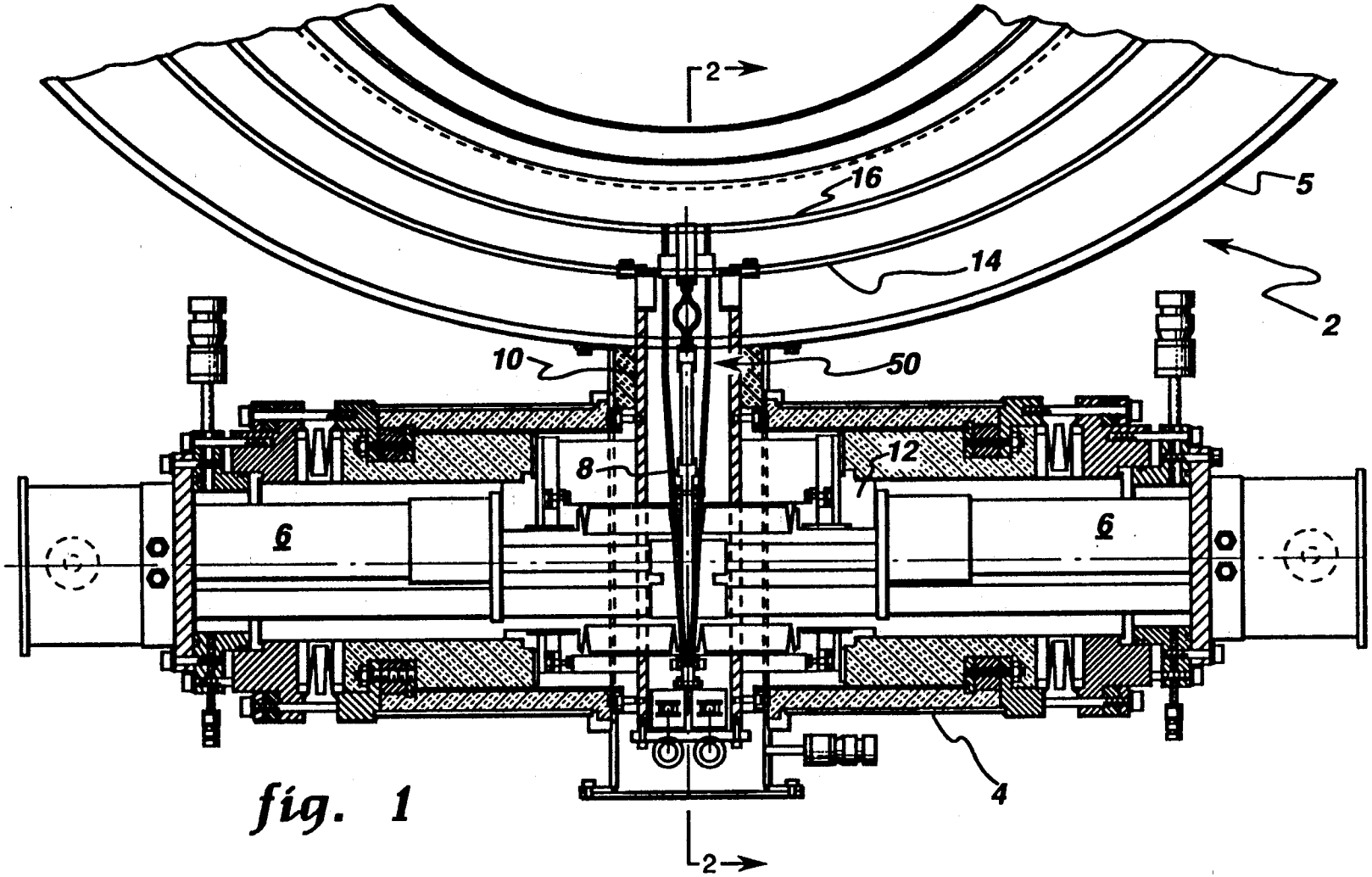
FIG. 1 is a side plan view o a refrigerated magnet with a thermal busbar assembly for a cryostat dual penetration, according to the present invention.
Figure 2:
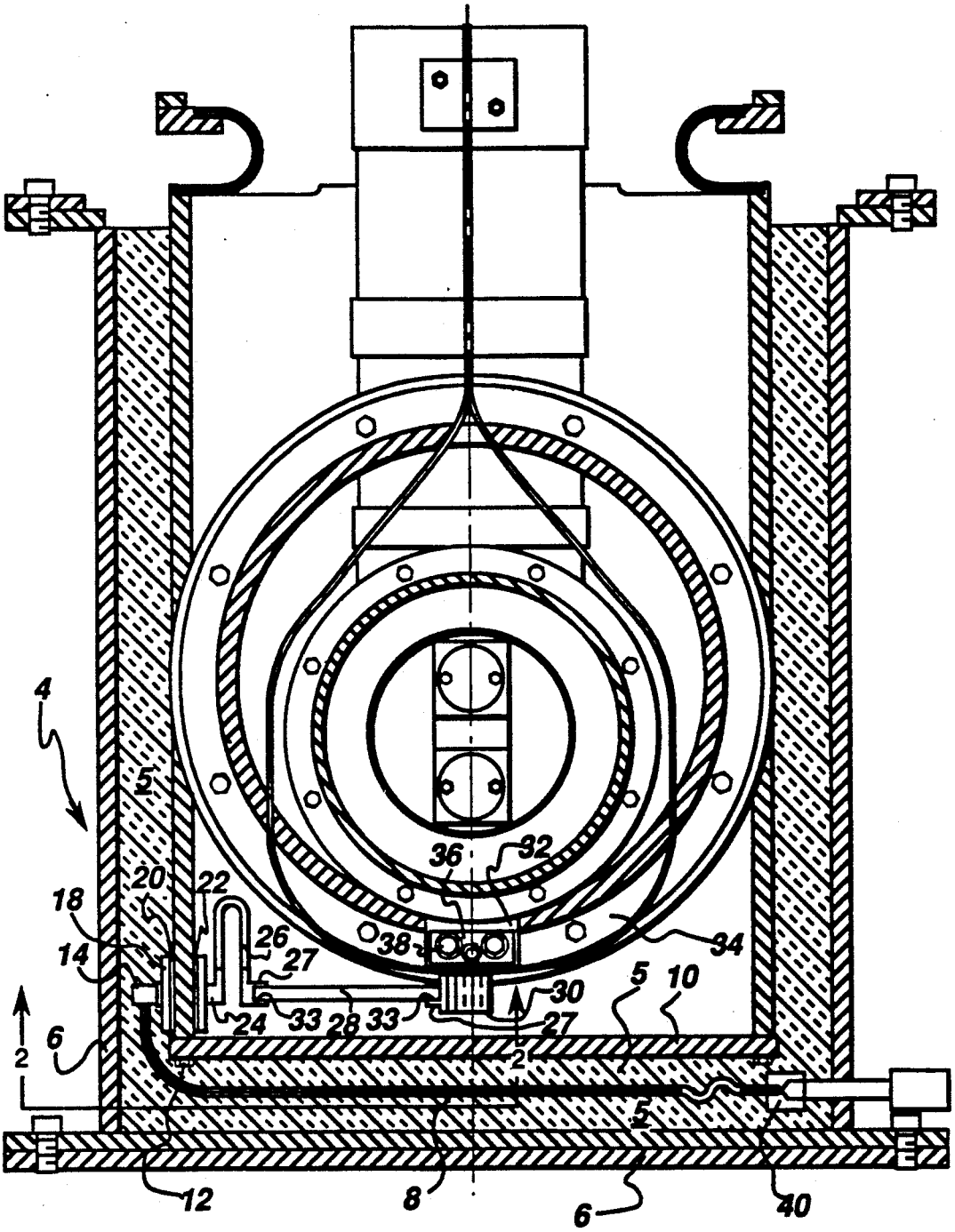
FIG. 2 is a side view taken along lines 2—2 of FIG. 1.

With reference first to FIGS. 1 and 2, there is illustrated a refrigerated magnet system 2 with a thermal busbar assembly 50. In particular, magnet system 2 includes, in part, vacuum enclosures 4 and 5, conventional refrigerator cold heads 6, 10K thermal station 8, 50K thermal shield 10, 50K thermal station 12. Enclosures 4 and 5, preferably, are constructed of stainless steel. In the present embodiment, cold heads 6, are Cryomech GB-04 refrigerators manufactured by Cryomech. Thermal stations 8 and 12 and shield 10, preferably, are constructed of OFHC copper.

Magnet system 2 also includes conventional thermal shield 14 and conventional magnet cartridge 16. Thermal busbar assembly 50 is rigidly attached to magnet cartridge 16 such that thermal busbar assembly 50 can provide a thermal path for continuous cooling of magnet cartridge 16. A detailed description of the attachment of thermal busbar assembly 50 to magnet cartridge 16 will be provided later.

Figure 3:
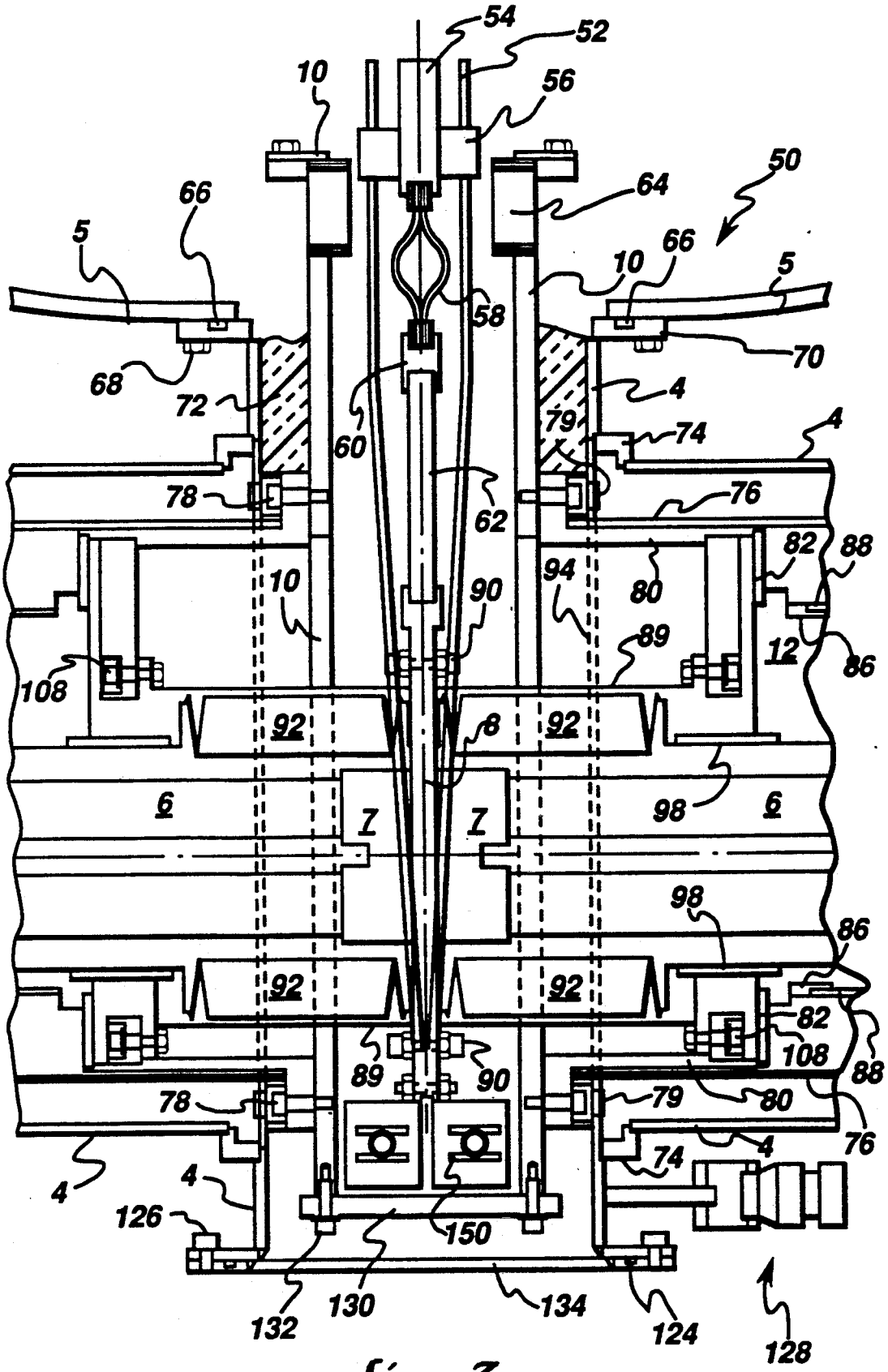
FIG. 3 is a detailed illustration of a thermal busbar assembly, taken from the dashed outline within FIG. 1.

With respect to FIG. 3, busbar assembly 50 is illustrated. In particular, assembly 50 includes, in part, lead busbars 52, thermal busbar 54, lead busbar support 56, radial/hoop thermal busbars 58, connector 60, axial thermal busbar 62, and 10K heat station 8. Lead busbar 52, preferably, are constructed of copper strips laminated by conventional lamination techniques with niobium-tin($Nb_3Sn$) superconductive material. Thermal busbars 58 and 62, preferably, are constructed of laminated sheets of OFHC copper. Thermal busbar 54 and connector 60, preferably, are constructed of OFHC copper. Support 56, preferably, is constructed of fiberglass reinforced epoxy. Busbars 52,54,58,62, connector 60, and 10K heat station 8, preferably, are rigidly attached by conventional techniques such as welding or soldering. 10K heat station 8, preferably, is thermally attached to superconducting lead assembly 150 by conventional fastener 112.

Located adjacent to busbar 58 are 50K flexible thermal busbars 64. Busbars 64, preferably, are constructed of laminated copper sheets. Thermal busbars 64 are rigidly attached to 50K thermal heat shield 10 by conventional welding or soldering. End plate 130 preferably, is constructed of OFHC copper is rigidly attached to shield 10 by conventional fasteners 132.

Located adjacent to shield 10 is thermal insulation 72. Thermal insulation 72, preferably, is constructed of multiple layers of aluminized mylar® polyester film. Vacuum enclosure 4 is located on the other side of insulation 72. Enclosure 4 is rigidly attached to magnet vacuum enclosure 5 by flange 70 and fasteners 68. A conventional elastomeric O-ring 66 is located in flange 70 in order to substantially prevent vacuum loss from the magnet vacuum enclosure. Vacuum enclosure 4 also includes support 74 which rigidly holds together both parts of vacuum enclosure 4 by conventional weldments.

50K stack 80 is rigidly attached to heat shield 10 by conventional fasteners 78. Stack 80, preferably, is constructed of OFHC copper. 50K support tube 76 is rigidly attached to stack 80 by conventional fasteners 79. Tube 76, preferably, is constructed of thin-walled stainless steel. 50K support plate 84 is rigidly attached to stack 80 by conventional soldering. Support 84, preferably, is constructed of stainless steel. Located adjacent to support 84 is flexible connection 82. Connection 82, preferably, is constructed of laminated copper sheets. Connection 82 is rigidly attached to stack 80 and 50K thermal station 12 by conventional welding or soldering. Extension 86, which, preferably, is constructed of stainless steel, is rigidly attached to station 12 by conventional soldering. Support tube 88 is rigidly attached to extension 86 by conventional welding or soldering. Support tube 88, preferably, is constructed of thin-walled stainless steel.

One end of 10K support tube 89 is rigidly attached to support 84 by conventional fasteners 108. Tube 89, preferably, is constructed of thin-walled stainless steel. The other end of tube 89 is rigidly attached to station 8 by conventional fasteners 90. Extension 98 is rigidly attached to support 84 by conventional welding or soldering. Extension 98, preferably, is constructed of stainless steel. One end of conventional cold bellows 92 are rigidly attached to extension 98 by conventional welding. Bellows 92, preferably, is constructed of stainless steel. The other end of bellows 92 is rigidly attached to station 8 by conventional soldering.

End cap 134 is rigidly attached to enclosure 4 by conventional fasteners 126. Cap 134, preferably, is constructed of stainless steel. A conventional elastomeric O-ring 124 is located in end cap 134 to substantially prevent a vacuum loss from magnet system 2 A conventional sensor feedthrough 128 is rigidly attached to enclosure 4 by a conventional welded connection.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A thermal busbar assembly for refrigerated superconductive magnets, said assembly comprised of:

a vacuum enclosure means;

a thermal shield means;

a superconductive magnet;

a first and second heat station means;

a lead busbar means electrically connected to said magnet means and thermally connected to said first heat station means;

a first thermal busbar means thermally connected to said magnet means and said second heat station means; and a second thermal busbar means thermally connected to said thermal shield means and said first heat station means.

2. The assembly, according to claim 1, wherein said lead busbar means is further comprised of:

copper strip laminated with superconductor materials.

3. The assembly, according to claim 1, wherein said first and second thermal busbar means are further comprised of:

laminated copper sheets.

4. The assembly, according to claim 1, wherein said assembly is further comprised of:

cold heads thermally connected to said first and second heat station means.

5. The assembly, according to claim 1, wherein said assembly is further comprised of:

first, second and third support tube means.

6. The assembly, according to claim 1, wherein said assembly is further comprised of:

a thermal stack means located adjacent to said vacuum enclosure.

7. The assembly, according to claim 6, wherein said first support tube means is rigidly attached to said thermal stack means.

8. The assembly, according to claim 6, wherein said second support tube means is rigidly connected to said first heat station means.

9. The assembly, according to claim 1, wherein said assembly is further comprised of:

a cold bellows means which is rigidly attached to said first and second heat station means.

10. The assembly, according to claim 1, wherein said assembly is further comprised of:

an insulation means substantially located between said enclosure means and said first heat station means.

11. The assembly, according to claim 6, wherein said first and second support tube means are further comprised of:

a flexible connection means located between said first and second support tube means.

12. The assembly, according to claim 6, wherein said assembly is further comprised of:

a first thermal shield means rigidly and thermally attached to said first tube means.

13. The assembly, according to claim 12, wherein said third support tube means is located adjacent to said first and second heat station means.

* * * * *